United States Patent [19]

Shirey

[11] 4,059,330

[45] Nov. 22, 1977

[54] SOLDERLESS PRONG CONNECTOR FOR COAXIAL CABLE

[75] Inventor: James W. Shirey, Lakeland, Mich.

[73] Assignee: John Schroder, Howell, Mich.; a part interest

[21] Appl. No.: 712,955

[22] Filed: Aug. 9, 1976

[51] Int. Cl.[2] ..... H01R 17/04

[52] U.S. Cl. ..... 339/177 R; 29/628; 339/221 R

[58] Field of Search ..... 339/177 R, 177 E, 221; 174/75 C, 88 C, 89

[56] References Cited

U.S. PATENT DOCUMENTS

| | | | |
|---|---|---|---|
| 2,049,585 | 8/1936 | Gunthorp | 339/221 R |
| 2,839,595 | 6/1958 | Felts et al. | 339/177 R |
| 3,573,712 | 4/1971 | Shirey | 339/177 E |
| 3,728,666 | 4/1973 | Shirey | 339/177 R |

FOREIGN PATENT DOCUMENTS

| | | | |
|---|---|---|---|
| 1,443,303 | 5/1966 | France | 339/177 E |

*Primary Examiner*—Roy Lake
*Assistant Examiner*—Neil Abrams
*Attorney, Agent, or Firm*—Hauke & Patalidis

[57] ABSTRACT

A solderless prong connector for permanent mounting on the end of a coaxial shielded cable of the type having an inner conductor surrounded by an inner dielectric sleeve in turn surrounded by a tubular braided conductor in turn surrounded by an outer dielectric sleeve. The connector has an electrically conductive tubular body member passed over the coaxial cable, the body member being provided with an enlarged inner diameter portion on one end in which is press-fitted a dielectric tubular plug wedging the cable outer dielectric sleeve and tubular braided conductor between the peripheral surface of the plug and the inner surface of the enlarged diameter bore of the conductive body member, with the end portion of the tubular braided conductor engaged with a portion of such bore surface. The cable inner conductor, having its end exposed, and the inner dielectric sleeve covering the inner conductor are disposed in a longitudinal bore in the plug, and a prong is press-fitted in the tubular plug bore such as to wedge the exposed end of the inner conductor between the peripheral surface of the prong and the inner surface of the plug bore, thus providing secure mechanical and electrical connections and forming water-tight seals. A coaxially disposed threaded collar engaging a shoulder portion of the conductive tubular body member fastens the plug to an appropriate coaxial female receptacle and provides electrical continuity between the cable braided conductor and the female receptacle housing.

8 Claims, 7 Drawing Figures

FIG. 1
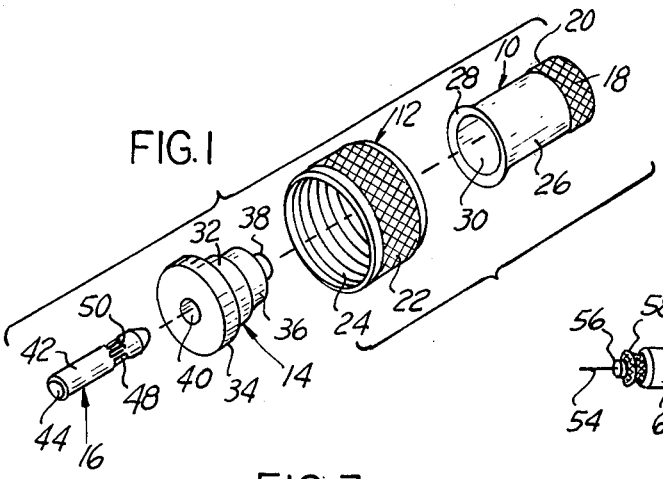
FIG. 2
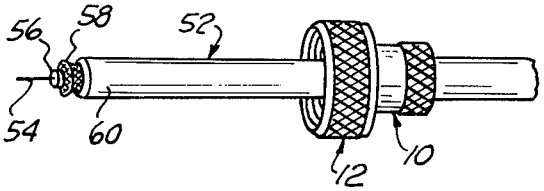
FIG. 3
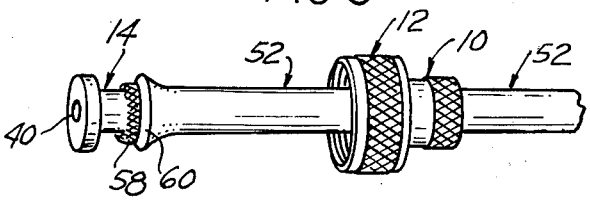
FIG. 4
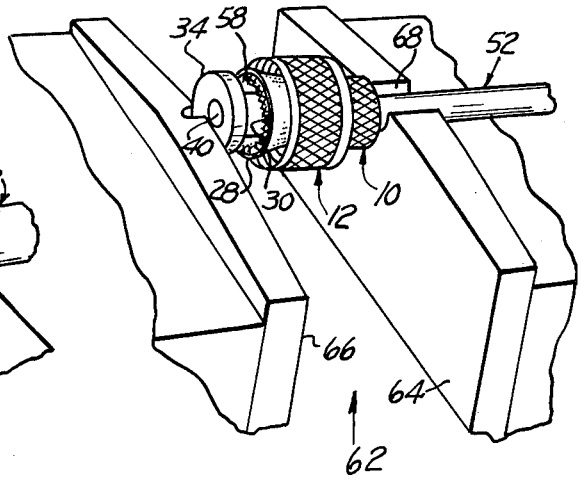
FIG. 5
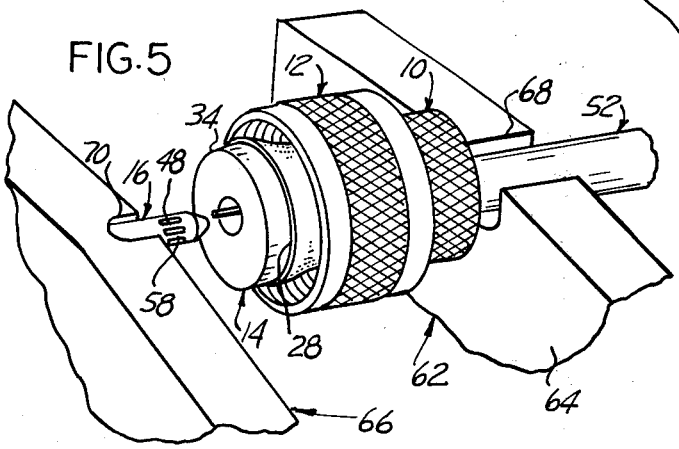
FIG. 6
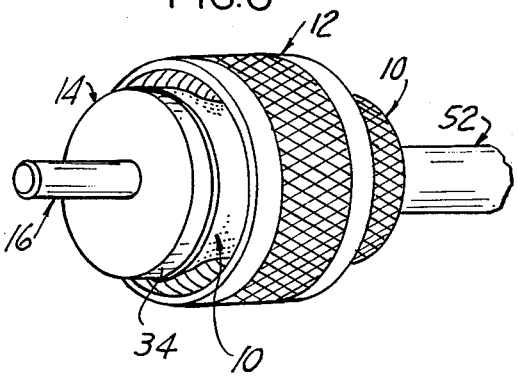
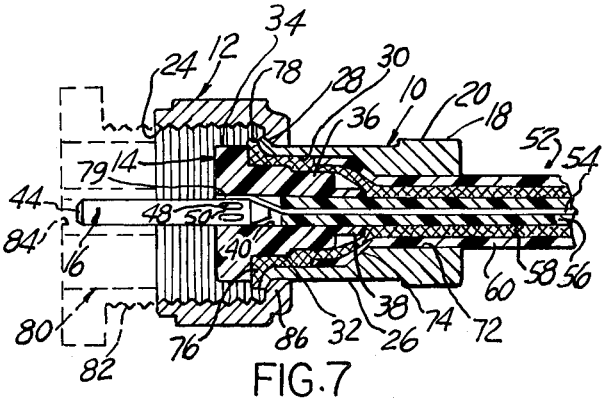
FIG. 7

SOLDERLESS PRONG CONNECTOR FOR COAXIAL CABLE

BACKGROUND OF THE INVENTION

The present invention relates to the field of electrical connectors and more particularly to male connectors mounted on the end of a flexible coaxial cable of the type consisting of an inner central conductor of solid or stranded current conductive metallic wire, covered by a cylindrical layer or sleeve of dielectric material, the dielectric material being in turn covered by a cylindrical tubular metallic braid forming the outer conductor of the cable. The outer tubular conductor is in turn usually covered with a cylindrical layer or sleeve of insulation, made of a material having good mechanical and weather resistant properties.

Coaxial cables of this type are used extensively today for connection between an antenna or aerial for propagation or reception of high frequency radio waves, the input of a radio receiver, or the output of a radio transmitter. The connection to the input of the radio receiver, or the output of the radio transmitter which in small radio apparatus such as those operating in the 27 megacycle band, usually referred to as the Citizen Band, are generally in the form of a common female receptacle having a cylindrical socket in which is inserted the prong of the male connector, and a peripheral thread over which is engaged the internally threaded collar member portion of the male connector. The prong is electrically connected to the inner conductor of the coaxial cable, and the collar portion of the connector is electrically connected to the tubular braided portion of the cable. The connection between the prong and the inner conductor of the cable is often done by crimping or soldering. The connection between the outer tubular braided conductor and the connector threaded collar is made by soldering the braided conductor to the connector body in turn in mechanical and electrical engagement with the threaded collar.

The soldered or crimped connections provide electrical connection and mechanical securing of the end of the coaxial cable to the connector, and the connector in turn is attached by means of the threaded ring or collar to the externally threaded surface of an appropriate female receptacle mounted on the radio transceiver chassis or to a female straight, T-, or Y-connector or other equipment, the female receptacle or connector having a current conductive socket frictionally accepting the prong. Soldering the conductors of a coaxial cable to a coaxial connector presents the inconveniences of requiring the availability of a soldering iron and a certain amount of skill on the part of the person mounting the connector upon the end of the cable. In addition, heat is required for soldering the inner conductor in the hollow prong and the outer tubular braided conductor to the connector body. Heat damage may affect the insulating quality of the dielectric portions of the cable and of the connector, and solder connections are incapable of effecting strong mechanical connections or providing waterproof connections.

Solderless coaxial cable prong connectors have been developed, as disclosed in U.S. Pat. Nos. 3,573,712 and 3,697,930 in the name of the present applicant and assigned to the same assignee as the present application, to remedy some of the inconveniences of soldered or crimped connectors. Solderless coaxial cable prong connectors present the advantage of eliminating the use of a soldering iron and of permitting to mount a connector on the end of a coaxial cable, using simple tools such as a pocket knife. Although perfectly capable of providing adequate electrical connections and strong mechanical connections, solderless connectors do not lend themselves easily to mass production assemblies of coaxial cables permanently provided with an appropriate connector at one end or at both ends.

SUMMARY OF THE INVENTION

The present invention has for its principal object to provide a coaxial cable prong connector consisting of only three separate parts for attaching to the end of a properly dressed coaxial cable, and which provides a permanent assembly which is water- and weather-proof, which is mechanically strong, and which results in superior electrical continuity between the cable conductors and the contact defining means of the connector.

Another object of the present invention is to provide a coaxial cable connector wherein the mechanical and electrical connections respectively between the inner conductor of a coaxial cable and the prong of the connector, and between the outer tubular braided conductor of the cable and the body of the connector, are effected by way of rigid mechanical clamping means, without resorting to soldering or crimping of the diverse conductors with the appropriate portions of the connector.

A further object of the present invention is to provide a coaxial connector construction having few parts, which is cheap in construction and leads directly to mass production at low costs, which permits to effectuate strong mechanical and electrical connections, which is easily and sturdily assembled on the end of a coaxial cable by automated assembly means and methods, which is water- and weather-proof, and which provides a coaxial connector permanently attached to the end of a coaxial cable.

The present invention accomplishes its objects by way of a single unit connector body made of an electrically conductive tubular sleeve to which is permanently attached a threaded collar member, rotatable relative to the connector body, the connector body having a bore accepting the cable therethrough, a dielectric tubular plug being inserted in an enlarged diameter bore portion of the connector body and wedging the outer insulator of the cable and the tubular braided conductor between the peripheral surface of the plug and the inner surface of the enlarged bore portion of the connector body, with the end of the tubular braided conductor in mechanical and electrical engagement with the surface of the bore in the connector body, and a prong partially inserted in the longitudinal bore of the plug, in electrical and mechanical engagement with the exposed inner conductor of the cable.

Other objects and advantages of the present invention will be apparent to those skilled in the art from the detailed description hereinafter of an example of embodiment thereof, given for illustrative purposes only, when the description is read in conjunction with the attached drawing wherein like reference numerals refer to like or equivalent parts and in which:

BRIEF DESCRIPTION OF THE DRAWING

FIG. 1 is an exploded perspective view of a coaxial cable prong connector according to the present invention;

FIGS. 2–5 are schematic perspective views of consecutive steps for attaching a prong connector according to the present invention to the end of a coaxial cable;

FIG. 6 is a perspective view of a prong connector according to the present invention mounted on the end of a coaxial cable; and FIG. 7 is a longitudinal section through a prong connector of the invention mounted on the end of a coaxial cable.

DETAILED DESCRIPTION OF THE PREFERRED EMBODIMENT

Referring now to FIG. 1, a solderless prong connector for permanent mounting on the end of a coaxial shielded cable, according to the present invention, consists of only four separate elements, two of which are normally supplied already assembled, the pair of elements normally supplied to the user assembled already consisting of a current conductive metallic tubular body member 10, and an internally threaded collar 12 which are shown separate at FIG. 1. The two other elements consist of a plug made of dielectric material, designated by numeral 14, and of a current conductive metallic prong 16.

The connector tubular body member 10 has a peripheral end portion provided with a knurled surface 18 such as to form an end portion 20 of enlarged diameter as compared to the nominal diameter portion 26 of the body member 10. The threaded collar member 12 is also provided with a knurled peripheral surface, as shown at 22, and has a thread internally formed as shown at 24. The threaded collar member 12 is generally cup-shaped, with a rear wall portion, not shown at FIG. 1, having a bore corresponding substantially to the nominal outer diameter portion 26 of the connector body member 10. The threaded collar 22 is normally fitted coaxially over the connector body portion 26, as shown at FIGS. 2–7, and is retained between the enlarged end portion 20 of the connector body member 10 and the outwardly tapering end portion 28 of the connector body member. The connector body member 10 and the threaded collar 12 are conveniently made of appropriate metal bar stock such as bronze, copper, steel and like metals, or alloys, and are preferably nickel or cobalt coated, after manufacturing. They are conventionally produced on screw machines and like apparatus. As previously mentioned, the connector body member 10 and the threaded collar 12 are normally supplied as a sub-assembly unit, with the threaded collar 12 slipped over the portion 26 of the connector member 10, and the tapered enlarged end portion 28 of the connector body member 10 having been formed, for example, by impacting with an appropriate tool, such that the threaded collar 12 is slidably and rotatably retained in position between the enlarged ends 18 and 28 of the connector body member 10. The connector body member 10 has an axial stepped bore, the wide portion 30 of which is visible at FIG. 1.

The dielectric plug 14 is conveniently molded, or turned, from appropriate rods of nylon, delcron or other plastic materials having high electrical insulation properties. The dielectric plug 14 has a cylindrical body 32 of a nominal diameter which is substantially equal to the internal diameter of the bore wider portion 30 in the connector tubular body member 10. One end of the plug 14 is provided with an enlarged diameter portion 34, which is substantially wider than the connector body member bore portion 30, and its other end is provided with a reduced diameter portion 36 and a further reduced diameter projection 38. The plug 14 has an axial bore 40.

The prong 16 is made of a current conductive metal rod cut to length to form a body 42, provided with a forward rounded or beveled end 44 and a tapered rear end 46. A series of parallel spline-like depressions or serrations 48 are formed peripherally proximate the tapered end 46 of the prong 16, such as to slightly deform the metal of the prong body 42 between the spline-like depressions or serrations 48 outwardly in the form of parallel peripheral projections 50. The nominal diameter of the prong body 42 is substantially equal to the diameter of the bore 40 in the plug 14.

At FIG. 2 is shown a preparatory step for attaching the connector of the present invention at the end of a coaxial cable 52. The coaxial cable 52 has been appropriately dressed at its end such as to expose a small length of the internal conductor 54, a small length of the cylindrical internal insulation 56 and a small length of the cable tubular braided conductor 58. The braided conductor 58 is in turn covered by a relatively flexible dielectric sleeve or covering 60. The tubular sleeve-like covering 60 is made of generally weather resistant, dielectric material such as rubber or a polyvinyl plastic. Examples of such coaxial cable 52 are those designated in the trade as, for example, RG/U 58 coax cable having an outer diameter of 0.208 in., RG/U 59, having an outer diameter of 0.255 in., and the like.

The part consisting of the sub-assembly of the connector body member 10 and the threaded collar 12 is slipped over the cable 52, as shown at FIG. 2, and, subsequently, the plug 14 is slipped between the inner insulation 56 and the braided conductor 58 of the cable, as shown at FIG. 3, the central conductor 54 and its insulation 56 projecting within the axial bore 40 of the plug.

The plug 14 is subsequently pressed into the bore 30 of the connector body member 10, by any appropriate means, as shown at FIG. 4, such as by means of a compressed-air operated vise 62, or hydraulic vise, or hydraulic press and the like, provided with an appropriate fixture consisting of a pair of jaws 64 and 66 reciprocable relative to each other. One of the jaws, such as for example jaw 64, has a slot 68 or other recess accepting the body of the cable 52 therein, and the jaw 66 and 64 are mutually reciprocated so as to press fit the plug 14 into the bore portion 30 of the connector body 10, until the enlarged diameter portion 34 of the plug abuts against the outwardly tapered end 28 of the connector body 10, in which position, as illustrated at FIG. 5, the end of the inner conductor 54 is caused to project slightly from the bore 40 in the plug 14. The prong 16 is then pressed into the bore 40 in the plug 14, with its tapered end 46 first. The prong 16 is inserted in a holding pocket 70 formed in the jaw 66, the jaws 64 and 66 being once again reciprocated towards each other until the face of the jaw 66 engages the end face of the plug 14 causing the prong 16 to be press-fitted in the bore 40 an appropriate distance slightly beyond the peripheral serrations 48–50, as determined by the depth of the holding pocket 70 in the jaw 66.

The assembly of the connector of the invention on the end of the cable 52 is now completed, as shown at FIG. 6.

FIG. 7 represents in cross section the plug connector of the invention mounted on the end of a coaxial cable 52. The connector body member 10 has a reduced diameter bore portion 72 which firmly engages the periphery of the relatively elastic dielectric sleeve 60 of the cable 52, such as to define a first weather- and water-proof barrier. The dielectric sleeve 60 of the cable 52 is firmly applied against a tapered annular surface 74 disposed between the bore portion 72 and the relatively enlarged bore 30 of the connector body member 10, as a result of the projection 38 of the plug 14 pressing firmly against the inside of the braided conductor 58, with the result that the outer dielectric sleeve 60 of the coaxial cable 52 is for all practical purposes squeezed between the braided conductor and the tapered annular surface 74, thus forming a second weather-proof barrier and a strong mechanical connection between the connector body 14 and the cable 52. Furthermore, the end of the cable dielectric sleeve 60 is also additionally firmly held as a result of being squeezed between the slightly reduced diameter portion 36 of the plug 14, pushed under the braided conductor 58 and the inner surface of the bore portion 30 of the conductor body member 10, thus providing a further weather- and water-proof seal and an additional strong mechanical connection between the connector and the cable.

The exposed end portion of the braided conductor 58, is firmly anchored, as shown at 76, between the nominal diameter body portion 32 of the plug 14 and the bore 30 of the connector body member 10, and also between the outer surface of the outwardly tapered end 28 of the body member 10 and the annular surface 78 defined below the enlarged diameter portion 34 of the plug 14. It will be appreciated that the dielectric material of which the plug 14 is made is only slightly resilient, with the result that the pressure exerted by the peripheral surfaces of the plug, having a nominal diameter about equal to the internal bore 30 in the connector body 10, is quite high, such that a strong mechanical connection between the connector and the cable is effected and a strong electrical connection is provided between the tubular braided conductor 58, and with the surface of the bore 30 of the connector body 10, as shown at 76.

As can also be seen at FIG. 7, the end portion of the internal dielectric 56 covering the inner conductor 54 projects a certain distance into the bore 40 in the plug 14, and as the plug 14 is tightly wedged in the bore 30 of the connector body member 10, there results a slight decrease of the diameter of the plug bore 40, tending to clamp the end of the inner insulation 56 in position in the bore 40.

The prong 16 is, as previously described, press-fitted in the end of the bore 40 in the plug 14, the exposed end portion of the inner conductor 54 being strongly clamped, as shown at 79, between the peripheral surface of the prong 16 and the surface of the bore 40 in the plug. Because the material forming the plug 14 is slightly resilient and slightly deformable, the presence of the end of the inner conductor 54 between the periphery of the prong 16 and the surface of the bore 40 in the plug 14, as shown at 79, tends to deform partially elastically and partially permanently a portion of the bore 40, with the result that the inner conductor 54 is strongly clamped in position, and the prong 16 is firmly implanted in the bore 40, the serrations 48, and the slightly projecting surface portions 50 therebetween further providing additional interference preventing accidental removal of the prong 16 from the bore 40 in the plug 14.

As further shown at FIG. 7, the connector of the present invention provides a means for mechanically and electrically connecting the coaxial cable 52 to a coaxial receptacle, shown in dash lines at 80, the female receptacle 80 being provided with a housing having a peripheral thread 82 engageable with the internal thread 24 in the threaded collar 12, the prong 44 of the connector projecting into a current conductive socket 84 forming part of the female receptacle 80. When tightened on the female receptacle 80, the threaded collar 12 provides electrical continuity between the braided conductor 58 and the housing of the female receptacle as a result of the inwardly projecting annular portion 86 of the collar 12 firmly engaging the outer surface of the outwardly tapered end 28 of the connector body member 10 substantially as shown at FIG. 7.

It will be appreciated that the solderless coaxial connector of the present invention, not only leads itself to mass production at low cost, as consisting only of a few simple and easily manufactured parts, but that it further lends itself to the use of automated or mass assembly of coaxial connectors on the end of a coaxial cable. It will be appreciated by those skilled in the art that the sub-assembly consisting of the connector body member 10 and of threaded collar 12 can be inserted by automatic feeding means over the end of individual coaxial cables 52, as illustrated at FIG. 2, which have their ends appropriately dressed either after or prior to the insertion of the connector body member-collar sub-assembly over the cable end, and that the plug 14 may subsequently be inserted in its position and press-fitted by automatic means, subsequently to which the prong 16 may be press-fitted into the bore 40 of the plug, also by automatic feed and assembly means. It will also be appreciated that the method of assembly hereinbefore described may be partially manual, with the step of press-fitting the plug 14 into the connector body member 10 and of press-fitting the prong 16 into the bore 40 of the plug being effected with the help of appropriate power tools.

Having thus described the present invention by way of a typical example of structure and of a method of assembly thereof, modifications whereof will be apparent to those skilled in the art, what is claimed as new is as follows:

1. A connector for mounting on the end of a coaxial shielded cable of the type having an inner conductor surrounded by an inner dialectric sleeve in turn surrounded by a tubular braided conductor in turn syrrounded by an outer dielectric sleeve, said connector comprising:

an electrically conductive tubular body member having a first longitudinal bore accepting the coaxial cable, a second longitudinal bore of enlarged diameter and an end portion at the end of said second bore provided with an enlarged outer diameter and inner diameter portion;

a dielectric tubular plug having a longitudinal bore accepting the inner dielectric sleeve of said cable, said tubular plug being inserted in said second bore of said tubular body member with the tubular braided conductor and the outer dielectric sleeve of said cable compressibly secured between the peripheral surface of said plug and the inner surface of said second bore with an exposed end portion of said tubular braided conductor engaged with said inner surface of said second bore, said dielectric tubular plug having an enlarged outer diameter end portion disposed in the enlarged inner diameter portion of the end portion of said tubular body member and compressibly securing the exposed end portion of said tubular braided conductor between the enlarged outer diameter end portion of said tubular plug and the enlarged inner diameter portion at the end of said tubular body member;

an electrically conductive prong member partially inserted in the longitudinal bore of said dielectric tubular plug, an exposed end portion of said inner conductor being secured between a cylindrical portion of the peripheral surface of said prong and the inner surface of said bore in said tubular plug; and an electrically conductive collar member having a rearwardly disposed inwardly extending shoulder portion for engagement with the enlarged outer diameter portion of said tubular body member, said collar member having an internal thread for engagement with the external thread of a receptacle for said prong member.

2. The connector of claim 1 wherein said tubular body member has a second enlarged outer diameter end portion proximate the end of said first longitudinal bore for retaining the shoulder portion of said collar member between said first and second enlarged outer diameter end portions.

3. The connector of claim 2 wherein said second enlarged outer diameter end portion is provided by a knurled raised peripheral surface.

4. The connector of claim 1 wherein said prong member has a portion of its peripheral surface inserted in the longitudinal bore of said dielectric tubular plug provided with regularly disposed spline-like projections.

5. The connector of claim 1 wherein said collar member is provided with a knurled peripheral surface.

6. The connector of claim 1 wherein said tubular plug has a reduced diameter axially disposed integral projecting portion for internally engaging said tubular braided conductor for forcing a portion of said braided conductor and a corresponding peripheral portion of the cable outer dielectric sleeve compressibly in engagement with an annular inner surface of said body member between said first and second bores of said body member.

7. The connector of claim 6 wherein said tubular plug has a peripheral surface of a nominal outer diameter about equal to the diameter of the second bore in said body member for compressibly clamping the end of said braided conductor between said peripheral surface of nominal diameter and said second bore while compressibly contracting said tubular plug, said peripheral surface of nominal outer diameter having a portion of reduced outer diameter adjacent to said axially disposed integral projecting portion.

8. The method of providing with an electrical connector the end of a coaxial shielded cable of the type having an inner conductor surrounded by an inner dielectric sleeve in turn surrounded by a tubular braided conductor in turn surrounded by an outer dielectric sleeve, said electrical connector comprising: an electrically conductive tubular body member having a first longitudinal bore accepting the coaxial cable, a second longitudinal bore of enlarged diameter and an end portion at the end of said second bore, provided with an enlarged outer diameter and inner diameter portion; a dielectric tubular plug having a longitudinal bore accepting the inner dielectric sleeve of said cable, said tubular plug being inserted in said second bore of said tubular body member with the tubular braided conductor and the outer dielectric sleeve of said cable compressibly secured between the peripheral surface of said plug and the inner surface of said second bore with an exposed end portion of said tubular braided conductor engaged with said inner surface of said second bore, said dielectric tubular plug having an enlarged outer diameter end portion disposed in the enlarged inner diameter portion of the end portion of said tubular body member and compressibly securing the exposed end portion of said tubular braided conductor between the enlarged outer diameter end portion of said tubular plug and the enlarged inner diameter portion at the end of said tubular body member; an electrically conductive prong member partially inserted in the longitudinal bore of said dielectric tubular plug, an exposed end portion of said inner conductor being secured between a cylindrical portion of the peripheral surface of said prong and the inner surface of said bore in said tubular plug, and an electrically conductive collar member having a rearwardly disposed inwardly extending shoulder portion for engagement with the enlarged outer diameter portion of said tubular body member, said collar member having an internal thread for engagement with the external thread of a receptacle for said prong member, said method comprising:

stripping the end of said cable such as to leave exposed a length of said inner conductor, a length of said inner dielectric sleeve and a length of said tubular braided conductor;

slipping over said end of said cable the electrically conductive tubular body member;

inserting said tubular plug under said tubular braided conductor with the end portions of said inner conductor and of said inner dielectric sleeve disposed within the bore of said plug;

press-fitting said tubular plug surrounded by the end portions of said tubular braided conductor and of said outer dielectric sleeve in the enlarged diameter bore of said electrically conductive tubular body member with the exposed end of said tubular braided conductor engaged with said bore; and press-fitting an end of said prong member in the bore of said dielectric tubular plug with the exposed end of said inner conductor engaged with a surface portion of said prong member and the other end of said prong member projecting from the end of said tubular plug.

* * * * *